US008985655B2

(12) United States Patent
Kavanagh et al.

(10) Patent No.: US 8,985,655 B2
(45) Date of Patent: Mar. 24, 2015

(54) TOOL FOR COLLECTING DEBRIS

(75) Inventors: Neville Kavanagh, County Kildare (IE); Kevin Ward, County Dublin (IE)

(73) Assignee: Dramafreeze Limited, Dublin (IE)

( * ) Notice: Subject to any disclaimer, the term of this patent is extended or adjusted under 35 U.S.C. 154(b) by 513 days.

(21) Appl. No.: 13/141,746

(22) PCT Filed: Dec. 23, 2009

(86) PCT No.: PCT/EP2009/067905

§ 371 (c)(1),
(2), (4) Date: Aug. 3, 2011

(87) PCT Pub. No.: WO2010/072833

PCT Pub. Date: Jul. 1, 2010

(65) Prior Publication Data

US 2012/0133163 A1 May 31, 2012

(30) Foreign Application Priority Data

Dec. 23, 2008 (GB) ..... 0823396.7

(51) Int. Cl.

| | |
|---|---|
| ***B66C 1/42*** | (2006.01) |
| ***E01H 1/12*** | (2006.01) |
| ***B25B 7/00*** | (2006.01) |
| ***B25B 7/02*** | (2006.01) |
| ***B25B 7/06*** | (2006.01) |

(52) U.S. Cl.

CPC .. *E01H 1/12* (2013.01); *B25B 7/00* (2013.01); *B25B 7/02* (2013.01); *B25B 7/06* (2013.01)

USPC ..... 294/118; 294/50.8

(58) Field of Classification Search

USPC ..... 294/50.8, 50.9, 118, 50.5, 50.6, 54.5, 294/57; D8/4, 10; 56/400.12, 400.16, 56/400.18

See application file for complete search history.

(56) References Cited

U.S. PATENT DOCUMENTS

| | | | | | |
|---|---|---|---|---|---|
| 272,320 | A | * | 2/1883 | Ralston | 294/62 |
| 1,855,477 | A | * | 4/1932 | Emery | 294/104 |
| 2,554,911 | A | * | 5/1951 | Kettel | 294/50.9 |
| 3,169,034 | A | * | 2/1965 | Epstein | 294/16 |
| 4,215,889 | A | * | 8/1980 | Rayburn | 294/118 |
| 4,483,221 | A | * | 11/1984 | Hoskins | 294/118 |
| 4,948,188 | A | * | 8/1990 | Haslam | 294/54.5 |
| 4,953,347 | A | * | 9/1990 | Siegfried | 56/400.12 |
| 5,114,199 | A | | 5/1992 | Newcomer | |
| 5,186,506 | A | | 2/1993 | Gale | |
| D341,300 | S | * | 11/1993 | Parsons | D8/5 |
| D384,865 | S | * | 10/1997 | Baran | D8/4 |
| 5,695,229 | A | * | 12/1997 | Chang | 294/51 |
| 5,727,828 | A | | 3/1998 | Jones | |
| D411,943 | S | * | 7/1999 | Beaver | D8/1 |
| D582,737 | S | * | 12/2008 | Mullen | D8/10 |
| D634,593 | S | * | 3/2011 | Kavanagh et al. | D8/4 |

FOREIGN PATENT DOCUMENTS

| | | | |
|---|---|---|---|
| CA | 2626824 | A | 9/2008 |
| GB | 18854 | A | 0/1907 |
| GB | 777264 | A | 6/1957 |
| GB | 2370528 | A | 7/2002 |

* cited by examiner

*Primary Examiner* — Paul T Chin

(74) *Attorney, Agent, or Firm* — Brian L. Michaelis; Seyfarth Shaw LLP

(57) ABSTRACT

A manual tool that can be used for gathering waste material is provided. The tool includes a pair of opposing blades that cooperate with one another to enable the user to scoop, scrape and gather waste in a single device. The tool provides a large capture volume in a compact device the capture volume being closed to the lower side proximal a supporting surface and open to an upper side. The blades have a lip portion at the lower side thereof. The blades and legs are arranged such that when connected a greater portion of the capture surface of each blade projects forwardly than rearwardly of the leg.

34 Claims, 13 Drawing Sheets

TOOL FOR COLLECTING DEBRIS

FIELD

The present specification relates to a tool and in particular a manual tool for collecting debris.

BACKGROUND

There is a recurring need to collect or gather debris, for example, garden debris such as fallen leaves, or litter and waste, from the ground. Various solutions have been proposed in the prior art, for example, municipal authorities may make use of various vacuum devices to lift debris, however, such devices are generally limited in their operation to open spaces and would not be suitable for use in the confined spaces as they may be difficult to maneuver around obstacles and such devices would generally not be suitable for use in the domestic garden setting. Over the years various garden tools have also been used to lift or clear debris for example, shovel or rake and brush devices may often be used in combination. However, the use of a plurality of devices may often prove unwieldy and difficult for the user. The user will generally need to handle more than one tool in sequence and operation will often require that the user bend to effect a lifting of debris.

There are therefore a number of problems with the conventional devices and tools for collecting debris that need to be addressed.

SUMMARY

These needs and others are addressed by a tool in accordance with the teachings of the present specification.

The invention provides various arrangement of a tool for collecting debris having first and second legs, pivotably coupled to one another and each extending from an upper handle portion to a first and second lower collection blade respectively, the first and second collection blades being arranged relative to one another to define opposing capture surfaces.

According to a first aspect there is provided a tool for collecting debris having first and second legs, pivotably coupled to one another and each extending from an upper handle portion to a first and second lower collection blade respectively, the first and second collection blades being arranged relative to one another to define opposing capture surfaces

- the blades each comprise lower longitudinal edges arranged to meet in the closed position with the opposing capture surfaces sloping outwardly relative to each other from the lower longitudinal edges to define a capture volume which is closed at a lower side proximal to a supporting surface and open to an upper side,
- the opposing capture surface of each blade comprising an upper portion and a lower portion, the lower portion defining a beveled lip continuous with the upper portion, the upper portions of the blades being arranged at a first angle relative to each other and the lower lip portions being arranged at a second and greater relative angle to each other.

According to a second aspect, there is provided a tool for collecting debris having first and second legs, pivotably coupled to one another at a pivot joint and each extending from an upper handle portion to a first and second lower collection blade respectively, a movement of the handles effecting a movement of the blades between a range of open positions and a closed position, the first and second blades being arranged relative to one another to define opposing capture surfaces, wherein

- the blades each comprise lower longitudinal edges arranged to meet in the closed position with the opposing capture surfaces sloping outwardly relative to each other from the lower longitudinal edges to define a capture volume which is closed at a lower side proximal to a supporting surface and open to an upper side,
- the opposing capture surface of each blade comprising an upper portion and a lower portion, the lower portion defining a beveled lip continuous with the upper portion, the upper portions of the blades being arranged at a first angle relative to each other and the lower lip portions being arranged at a second and greater relative angle to each other, and
- the blades and legs are connected such that a greater proportion of the capture surface of each blade projects to the front than to the rear of the leg.

According to a third aspect there is provided a tool for collecting debris having first and second legs, pivotably coupled to one another at a pivot joint and each extending from an upper handle portion to a first and second lower collection blade respectively, a movement of the handles effecting a movement of the blades between a range of open positions and a closed position, the first and second blades being arranged relative to one another to define opposing capture surfaces, wherein

- wherein the blades and legs are arranged such that when connected a greater proportion of the capture surface of each blade projects forwardly than rearwardly of the leg.

According to a fourth aspect there is provided a tool for collecting debris having first and second legs, pivotably coupled to one another at a pivot joint and each extending from an upper handle portion to a first and second lower collection blade respectively, a movement of the handles effecting a movement of the blades between a range of open positions and a closed position, the first and second blades being arranged relative to one another to define opposing capture surfaces, wherein

- the legs are connected to the blades such that in use with the lower edges of the blades resting on the ground or supporting surface, the legs are oriented rearwardly relative to the lower edge or of the blades in the direction of a user standing to the rear of the tool.

According to a fifth aspect there is provided a tool for collecting debris having first and second legs, pivotably coupled to one another and each extending from an upper handle portion to a first and second lower collection blade respectively, the first and second collection blades being arranged relative to one another to define opposing capture surfaces

- the blades each comprise lower longitudinal edges arranged to meet in the closed position with the opposing capture surfaces sloping outwardly relative to each other from the lower longitudinal edges to define a capture volume which is closed at a lower side proximal to a supporting surface and open to an upper side,
- the legs are connected to the blades such that in use with the lower edges of the blades resting on the ground or supporting surface, the legs are oriented rearwardly relative to the lower edge or of the blades in the direction of a user standing to the rear of the tool.

There is further provided a tool for collecting debris having first and second legs, pivotably coupled to one another at a pivot joint and each extending from an upper handle portion to a first and second lower collection blade respectively, a movement of the handles effecting a movement of the blades between a range of open positions and a closed position, the first and second blades being arranged relative to one another to define opposing capture surfaces, wherein wherein the blades and legs are arranged such that when connected of the capture surface of each blade projects forwardly and rearwardly of the leg.

Such tools offer a number of advantages including the ability to scoop, scrape and gather material all in one motion. The provision of collection blades that pivot relative to one another about a fulcrum provides the user with an efficient tool for collection of debris material such as for example waste within a commercial or domestic environment. Indeed such efficient collection has application in any one of a number of different environments where there is a desire and need for collection of material in a manual fashion without requiring the user to physically contact with the material to be collected.

Various advantageous arrangements of the above first to sixth tool arrangements are noted as follows:

In one embodiment, the blades and legs are arranged such that when connected the capture surface of each blade projects forwardly and rearwardly of the leg.

In another embodiment the blades and legs are arranged such that when connected a greater proportion of the capture surface of each blade projects forwardly than rearwardly of the leg.

In one embodiment the blades each comprise lower longitudinal edges arranged to meet in the closed position with the opposing capture surfaces sloping outwardly relative to each other from the lower longitudinal edges to define a capture volume which is closed at a lower side proximal to a supporting surface and open to an upper side, In another embodiment the legs are connected to the blades such that in use with the lower edges of the blades resting on the ground or supporting surface, the legs are oriented rearwardly relative to the lower edge or of the blades in the direction of a user standing to the rear of the tool.

In a further embodiment the opposing capture surface of each blade comprising an upper portion and a lower portion, the lower portion defining a beveled lip continuous with the upper portion, the upper portions of the blades being arranged at a first angle relative to each other and the lower lip portions being arranged at a second and greater relative angle to each other In a further embodiment, the blades are arranged such that when closed the depth and relative angle of the lower portions thereof operably defines the separation of the corresponding upper portions thereof.

In one embodiment, each blade comprises a major longitudinal axis which extends from a forward side end to the rear side end thereof wherein the major axis is oriented substantially at right angles to the legs.

In another embodiment, the lower longitudinal edges of the blades are substantially straight and are configured to contact a supporting surface.

In a further embodiment, the blades are removably connectable to the legs.

In one embodiment, the upper and lower portions of the blades comprise a substantially planar form.

In another embodiment, the blades comprise a substantially rectangular form.

In a further embodiment, the blades comprise one or more through holes formed in the surface thereof.

In one embodiment, the lower portions or lip portions partially or wholly overlap when the blades are in the closed position.

In another embodiment, the blades are oriented to support the tool in a self standing position with the lower longitudinal edges of the blades in contact with a support surface when the blades are in an open position.

In a further embodiment, there is provided a plurality of sets of blades differing from one another in their form or material, the sets of blades being provided for different specific applications and being user replaceable such that depending on the application a user may interchange one blade set for another more appropriate blade set.

In one embodiment, the length of the blades is sufficient to allow the tool to be free standing with the handle extending upwardly from the blades.

In another embodiment, substantially two thirds of the surface area of each blade is arranged to the front of the leg.

In a further embodiment, substantially two thirds of the length of the lower longitudinal edge of each blade is arranged to front of the leg.

In one embodiment, the lower longitudinal edges are configured to substantially meet along their longitudinal extent from the front end to the rear end of the blade when closed.

In another embodiment, the surface area of the lower lip portion of each blade is less than that of the upper portion of each blade.

In a further embodiment, the upper and lower portions of the capture surface of each blade comprise a generally rectangular form.

In one embodiment, the capture volume comprises a generally v-shaped form.

In another embodiment, the capture volume comprises a broad base portion as defined by the relatively wide angle orientation of corresponding edges of the lower portions or lip portions which meet when closed.

In a further embodiment, the blades further comprise upper longitudinal edges, wherein the upper longitudinal edges are maintained at a separation when the blades are closed.

In one embodiment, the legs are coupled to the blades such that the legs are oriented rearwardly in the direction of the user an angle of substantially 7-15 or 11 to 19 degrees to the vertical when the lower edges of the blades are arranged to rest on the ground.

In another embodiment, the legs are coupled to the blades such that the legs are oriented at an angle of 75 to 83 or 71 to 89 degrees to the lower edges of the blades in the direction of a user standing to the rear side of the device.

In a further embodiment, the legs comprise an upper portion and a lower portion formed and arranged for connection to the blades.

In one embodiment, the pivot joint is located below a mid point of each leg from the upper handle end to the blade.

In another embodiment, a first leg comprises a recessed portion about the joint configured to accommodate movement of the second leg relative to the first about the joint.

In a further embodiment, the recessed portion defines a stop which limits the extent of movement of the legs relative to each other.

In one embodiment, the legs are formed as single unitary pieces.

In another embodiment, the legs comprise upper and lower bend features.

In a further embodiment, the legs are formed as solid bars of generally rectangular cross-section.

In one embodiment, the upper portion of the leg is arranged such that the broad side of the rectangular cross-section of the leg is oriented to the front and rear of the device.

In another embodiment, the legs comprise a tubular form substantially of circular cross-section.

In a further embodiment, the legs are formed such that the lower portions formed and arranged for connection to the blades are arranged to accommodate the outwardly sloping blades.

In one embodiment, the lower portions are formed and arranged for connection to the blades are configured to support the blades in the outward sloping configuration when closed, the lower portions extending outwardly relative to the pivot joint to a lower bend at which point the lower portion is angled relatively downwardly and inwardly to define a connection portion for connection to an outer surface of the blade.

In another embodiment, the connection portions of the legs comprise a rectangular cross-section oriented such that the broad side of the rectangular cross-section is presented to an outer surface of the blade for connection to the blade.

In a further embodiment, when the legs are of rectangular cross section the broad side of the rectangular cross section is oriented through the twist feature to provide a supporting overlap between each blade and leg.

These and other features of the present teaching will be better understood with reference to the exemplary arrangements which follow which are provided to assist in an understanding of the benefits derivable from the present invention but are not to be construed as limiting the present teaching to that specifically described.

BRIEF DESCRIPTION OF THE DRAWINGS

The present invention will now be described with reference to the accompanying drawings in which.

DETAILED DESCRIPTION OF THE DRAWINGS

Figure 1:
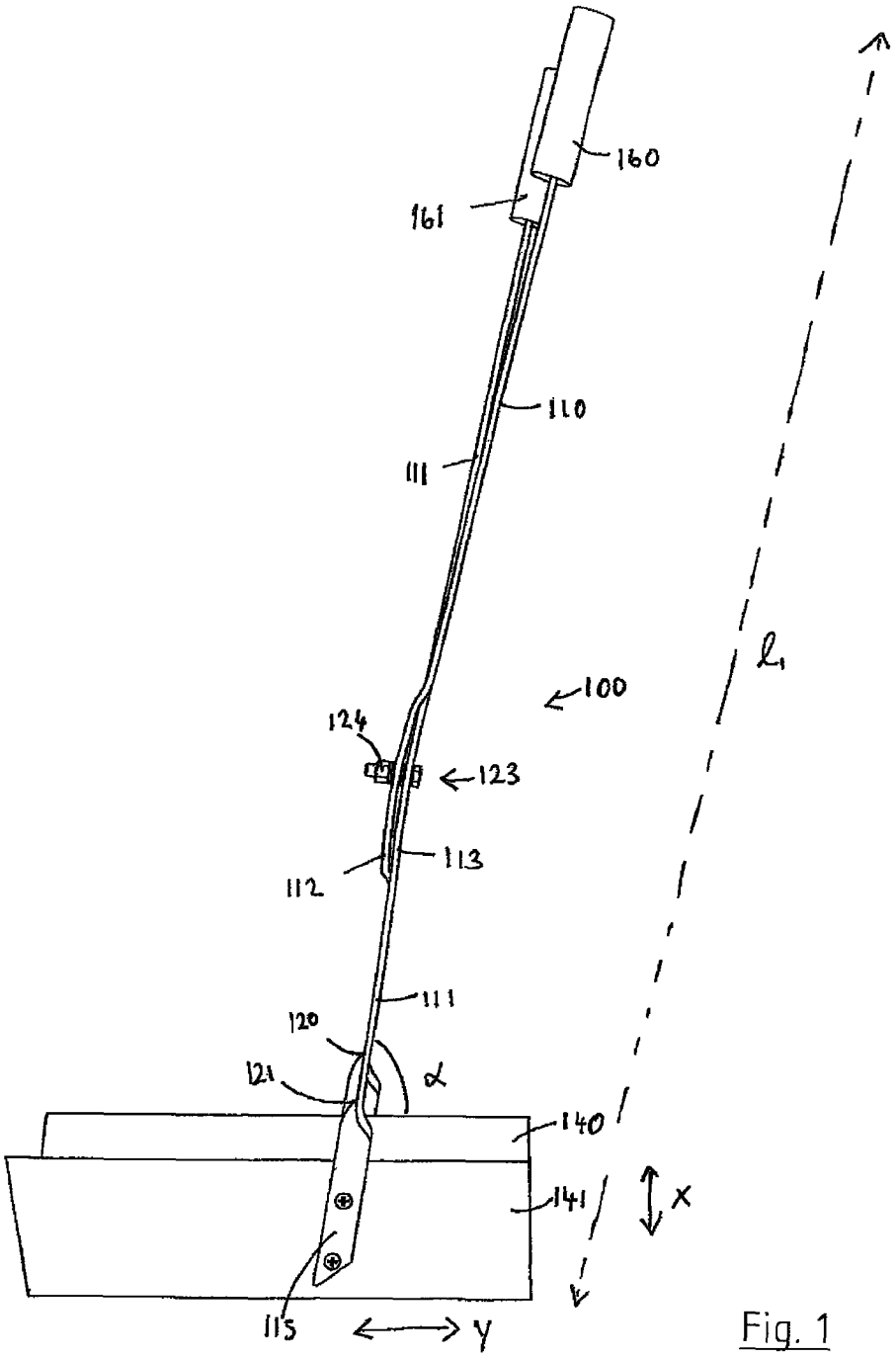
FIG. 1 is a perspective view from the side of a device according to an embodiment of the invention.
Figure 2:
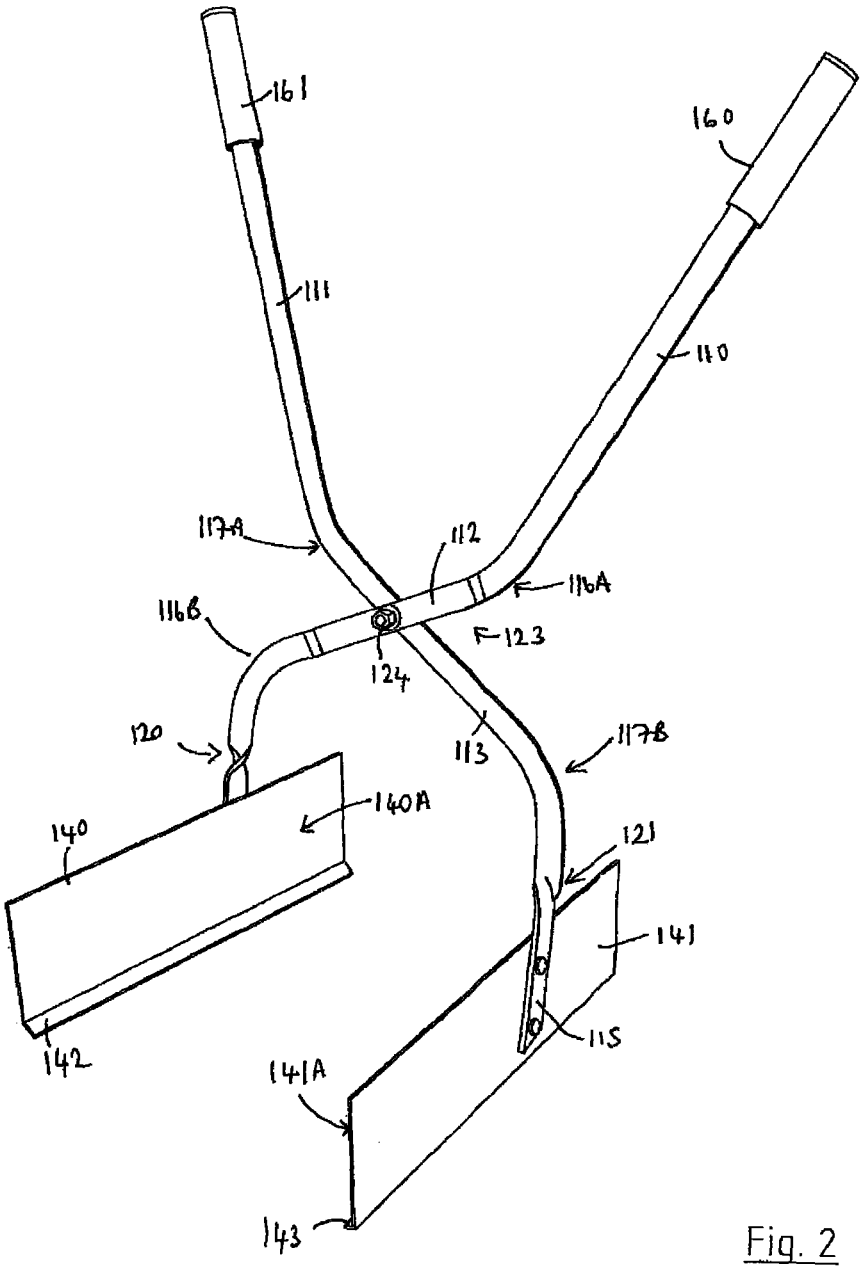
FIG. 2 is a perspective view from the side of the device of FIG. 1 in an open or self-standing mode of operation.

A manual tool 100 configured for collecting debris for use in a street cleaning or garden setting is described. It will be understood that its use in such an environment is exemplary of utility of such a tool and its application could be found in other environment such as for example an industrial environment where collection of waste or other material is required.

Referring to the drawings and initially FIGS. 1 to 4 and 9 to 14, the tool 100 comprises first and second legs 110 and 111 each having upper handle portions 160 and 161 and lower collection blades 140 and 141 (FIGS. 1-4) (and blade 280 similar to blades 140, 141 (FIGS. 9 to 14). The blades each define a capture surface which when in the closed position together define a capture volume 170. The blades 140 and 141 are arranged to project forwardly of the legs rather than in the plane of the legs.

The blades 140 and 141 (and 280) may be oriented to project in a direction substantially at right angles to the legs of the device. The blades are desirably coupled to the handles in fashion that orientates the handles rearwardly towards the user holding the device when the blades rest on the ground or supporting surface. Typical angles of orientation may be of the order of 7 to 15 degrees or 7 to 19 degrees. In the exemplary arrangement of FIGS. 9 to 14, the handles may be orientated rearwardly relative to the vertical in the direction of the user at an angle $\alpha$ in the range of 11 to 19 degrees, desirably around 13-15 degrees, most desirably about 14 degrees.

While a range of suitable angles of orientation of the legs or handles in the direction of the user relative to the vertical and to the lower edge of the blades is noted, it will be appreciated that the advantage is not limited to only a particular angle of orientation but lies in the fact that the legs or handles are oriented rearwardly towards the user at a suitable angle and the orientation of the legs is arranged to facilitate ease of handling of the device.

The first and second legs 110 and 111 are connectable and movable about a pivot joint 123. The legs 110, 111 are arranged such that movement of handles in a direction apart or together affects a corresponding movement of the blades between a range of open positions and a closed position when the blades are located in proximity to each other. Movement of the legs and handles and resultant movement of the blades is similar in manner to operation of a scissor device, in that the handles pivot about a fulcrum. This movement effects an opening and closing of a capture volume defined between the two blades.

The blades 140, 141 (and 280) each comprise a major axis in this case the longitudinal axis of the blade from the front end to the rear end thereof (shown in FIGS. 1, 3 and 11 as the Y-axis) and a minor axis oriented from the lower to upper end thereof. The blades 140, 141 (and 280) are configured to project forwardly and rearwardly of their point of connection 148 to the legs 110, 111.

Figure 3:
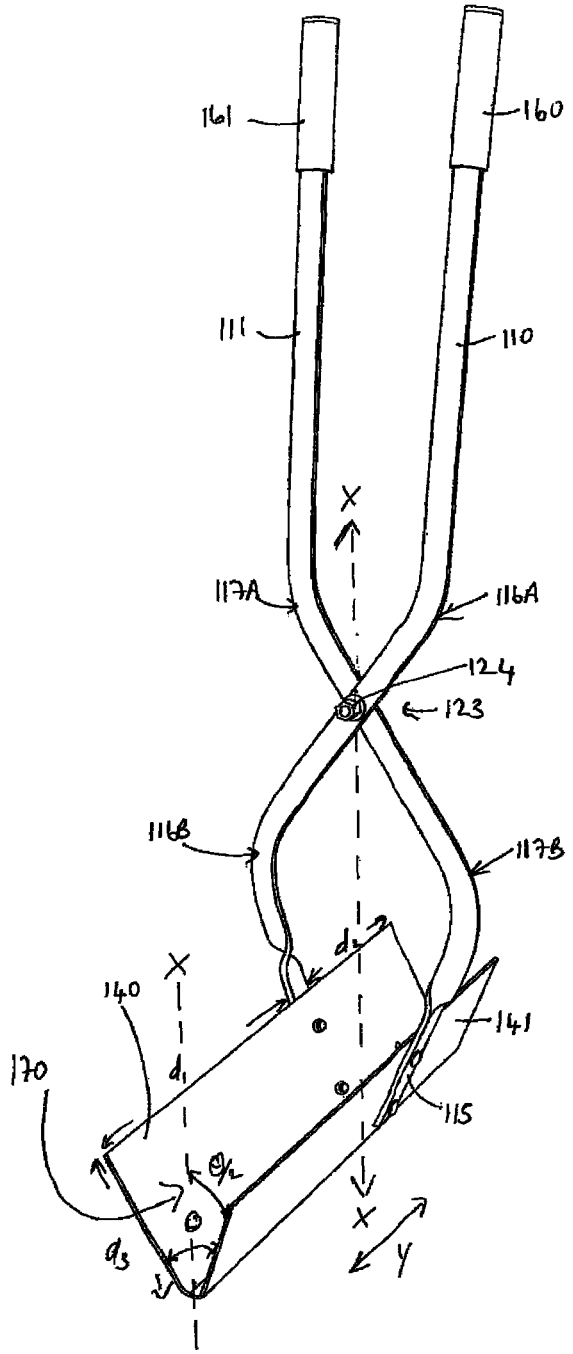
FIG. 3 is a perspective view from the front of the devices of FIGS. 1 and 2.
Figure 4:
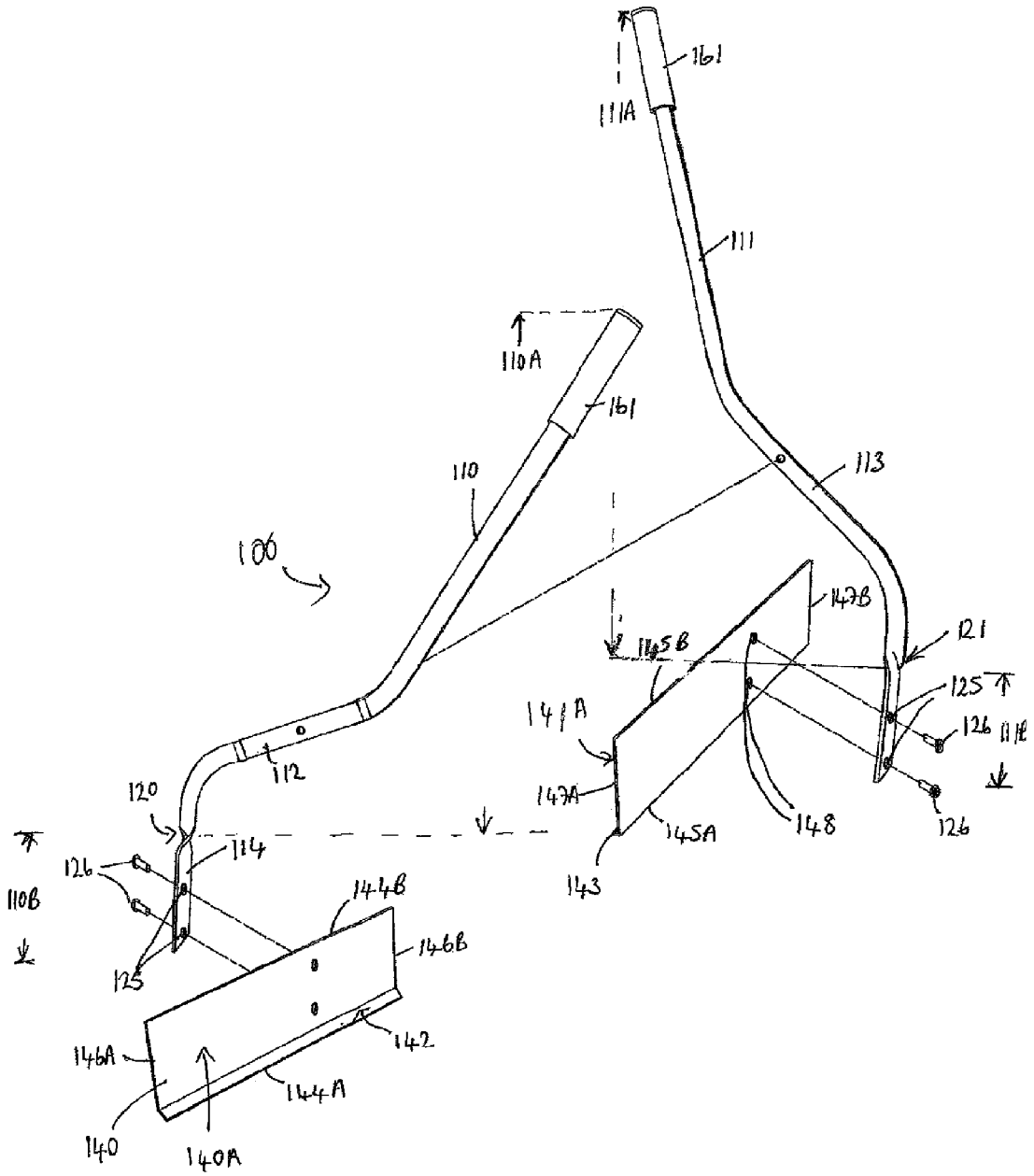
FIG. 4 is an exploded view of the component parts of the device of FIGS. 1-3.
Figure 5:
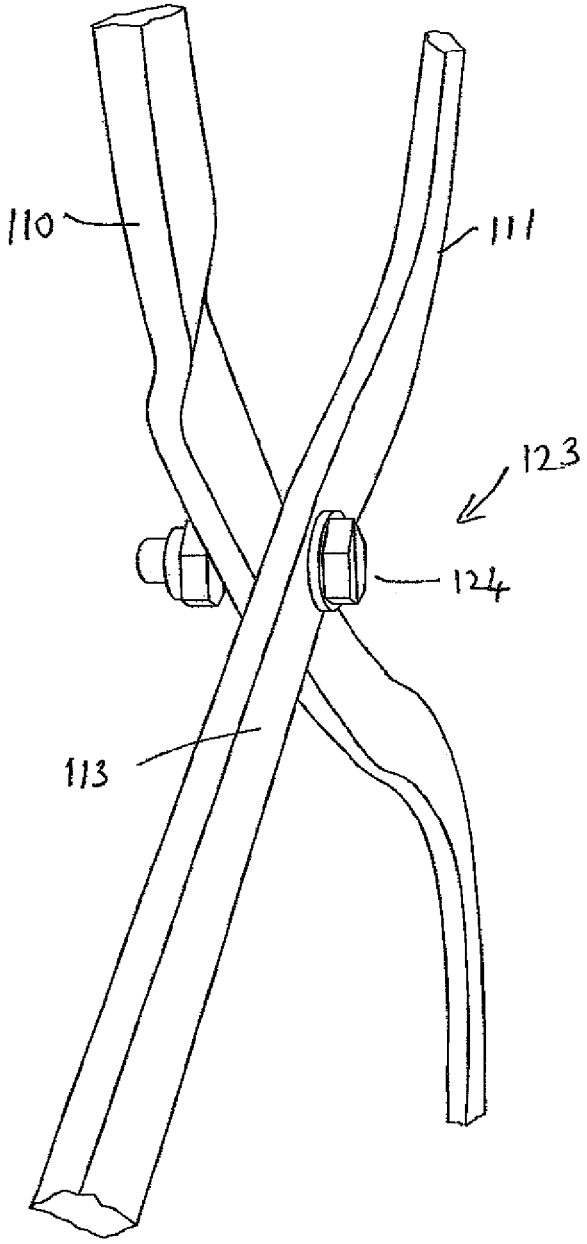
FIG. 5 is a detailed view of the joint of the device of FIGS. 1-4.
Figure 6:
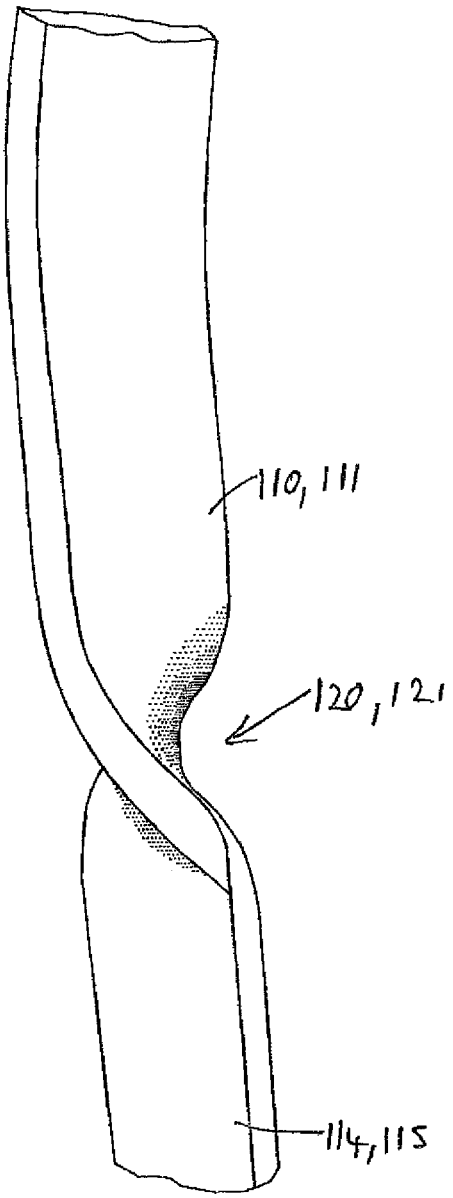
FIG. 6 is a detailed view of the turned back form of the legs of the device; and, FIGS. 7, 8 are perspective views of two different embodiments of the blades of the device.

In the exemplary embodiment of FIG. 3 the blades extend a distance dl forward of the connection and a distance d2 to the rear of the connection. Desirably the surface areas of the portion of the blades that projects forwardly of the handles is greater than the surface area of the blades that is located rearwardly of the connection. In this exemplary arrangement, d2 is substantially twice the length of d1. The major axis of the blades is substantially at right angles to the major axis or plane of the legs of the device and to the pivot joint. The greater portion of load of the blades on the legs is thus arranged projecting forwardly of the connection to the legs. This assists greatly in the utilization of the tool in a sweeping fashion whereby the user swings the tool forwardly to effect a gathering of collection material into the capture volume defined between the opposing blades.

This arrangement also assists in handling the device since the user can easily tilt the device back to lift the greater proportion of the capture volume which is located forward of the handle to blade connection off the ground thus assisting with lifting loads with the device, In the exemplary embodiments the blades 140, 141 (and 280) have a substantially rectangular form. The forward and rearward portions of the device are considered from the point of view of the in use orientation of the device in which the user stands to the rearward side of the device and the lower edges of the blades are located in proximity to the ground or supporting surface. The blade 140 has longitudinal lower and upper edges 144A and 144B and forward and rearward lateral side edges 146A and 146B. The blade 141 similarly has longitudinal lower and upper edges 145A and 145B and forward and rearward lateral side edges 147A and 147B.

The first and second blades 140, 141 (or 280) are operatively arranged relative to one another to define opposing capture surfaces. The blades each comprise lower longitudinal edges 144A and 145A arranged to substantially meet in the closed position. When the lower longitudinal edges 144A and 145A meet the opposing capture surfaces may be arranged to slope outwardly relative to each other from the lower longitudinal edges to define the capture volume 170 which is closed at a lower side proximal to a supporting surface and open to the upper side.

When in the closed position the lower edges 144A and 145A substantially meet. The upper edges 144B, 145B may be at a separation from each other in the closed position as in the exemplary embodiment of the drawings in which surfaces of the blades may be oriented to slope outwardly from each other from the lower edges 144A, 145A to the upper edges 144B, 145B at an angle θ. In the exemplary embodiment of the drawings, the angle θ is an acute angle and the capture volume 170 defined by the blades is substantially V-shaped in form. Referring to the drawings the minor axis of the blades which runs in the direction of the bottom edge to the top edge is in the exemplary embodiment arranged substantially at an angle of θ/2 to the X-axis as shown in FIG. 3.

When closed the blades are further configured to slope outwardly relative to each other about the central axis X of the device which is indicated in FIG. 3 as running through the pivot point 123 of the device at right angles to the line at which the blades meet when closed. In particular, in the closed position the blades slope outwardly relative to each other by an angle θ and relative to a central substantially vertical axis of the device illustrated as the X-axis in FIG. 3 by an angle θ/2.

The blades 140, 141 (and 280) and legs 110 and 111 may further be connected to each other such that a greater proportion of the capture surface of each blade projects to the front than to the rear of the leg or the point of connection of the blade to the leg.

The blades 140, 141 (and 280) may comprise blade comprising a main or upper blade portion and a lower blade portion. The lower blade portion may be defined by lip portions or beveled lips 142, 143 (and 282). The lower blade portions or lips 142, 143 (and 282) are continuous with the upper portion. The lower blade portions or lips are preferably arranged at an angle relative to the upper portions.

In such an arrangement the opposing capture surface of each blade 140, 141 (and 280) comprises an upper portion 140A and 141A (and 281) and a lower portion, the lower portion defining a beveled lip 142, 143 (and 282). In the closed position, the upper portions 140A and 141A of the blades are arranged at a first angle relative to each other and the lower lip portions are arranged at a second and greater relative angle to each other. The lower portion of the blade is arranged at an angle β relative to the upper portion. The angle β preferably an acute angle of the order of 10-50 degrees, desirably of the order of 30-40 degrees most desirably of the order of 33-37 degrees. While a range of suitable angles β is noted above. It is noted that other suitable angles may be used to provide the functionality required.

In effect, the lower or lip portions 142, 143 (and 280) of opposing blades cooperate when the blades are closed to offset or separate the upper blade portions by a distance defined by the depth of the lower lip portions and angle β of the lower lip portions relative to the upper lip portion.

The lower edges 144A, 145A (and 284) of the lower blade portions or beveled lips 142, 143 (282) may be arranged to substantially meet or abut when the blades are in the closed position. It will be appreciated that in an alternative arrangement the lips of the blades may be provided for example where they partially or wholly overlap which the blades are in the closed position.

In the arrangement in which the blades comprises upper 140A, 141A (and 281) and lower portions 141 and 142 (and 282) the capture surface of each blade is comprised of upper and lower capture surface portions arranged at different relative angles. The upper and lower capture surfaces of each blade together define a first lower v-shaped capture volume within a second v-shaped capture volume when the blades are closed. The overall form of the capture volume is substantially a v-shaped form having a relatively wide angled base portion.

Figure 7:
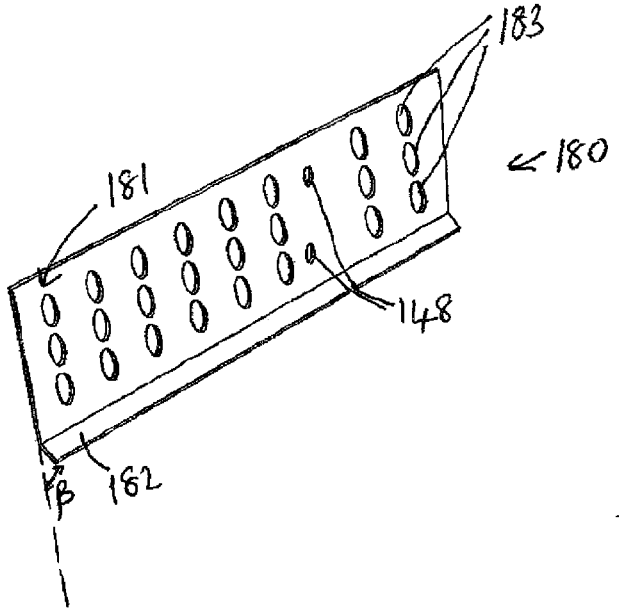
Figure 8:
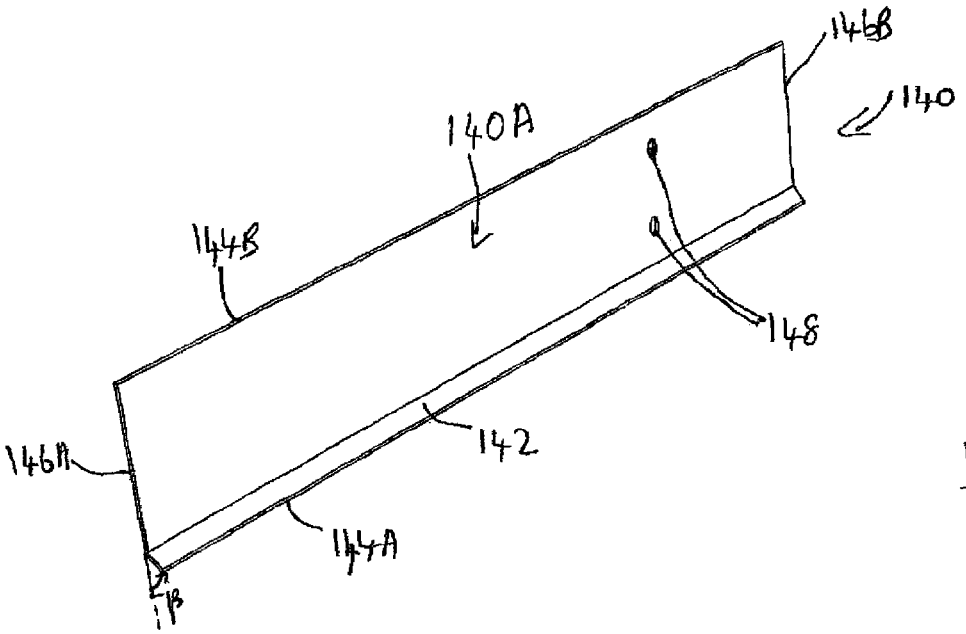

The blades may be removable or replaceable. Referring to FIGS. 7 and 8, the user may select from different blade types to be used depending on the type of debris to be collected. The blades 140 of FIGS. 1 to 7 are typically of a generally rectangular shape and present substantially planar blade surfaces. It will be appreciated that by providing removable or replaceable blades that different blades could be provided for different applications and depending on the utility, the user could simply replace one blade with another more appropriate blade for the application in hand. For example the blades could be provided with concave surfaces that when brought together define a receptacle within which fine particles such as sand or the like could be retained. For larger particles planar surfaces offer the greater range of application and referring to the exemplary arrangement of FIG. 8, the blade 180 has a generally rectangular form and the surfaces include a number of through holes 183 to provide for drainage of debris. The provision of through holes also advantageously reduces blade weight. The blades of the illustrated embodiments are connected to the legs by means of fixing pins through fixing holes at the points of connection 148. It will however be appreciated that a suitable alternative fixing means may also be used for example a releasable or slideable connection means may be provided. For example, by defining a channel within the end portion of the handles and then slotting the blades into that channel retention of the blade relative to the handle could be effected.

Figure 9:
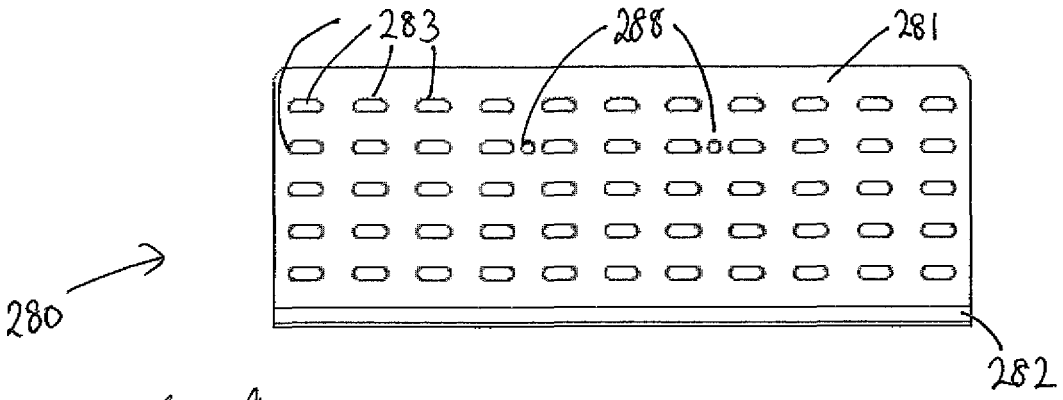
FIGS. 9 and 10 are a perspective view and side plan view of a blade of a different arrangement.
Figure 10:
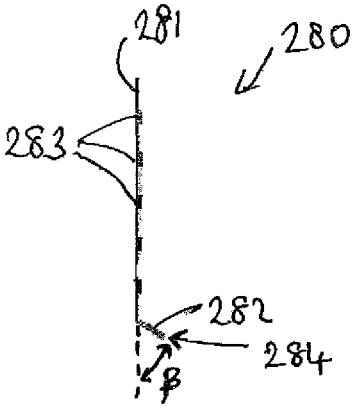
Figure 11:
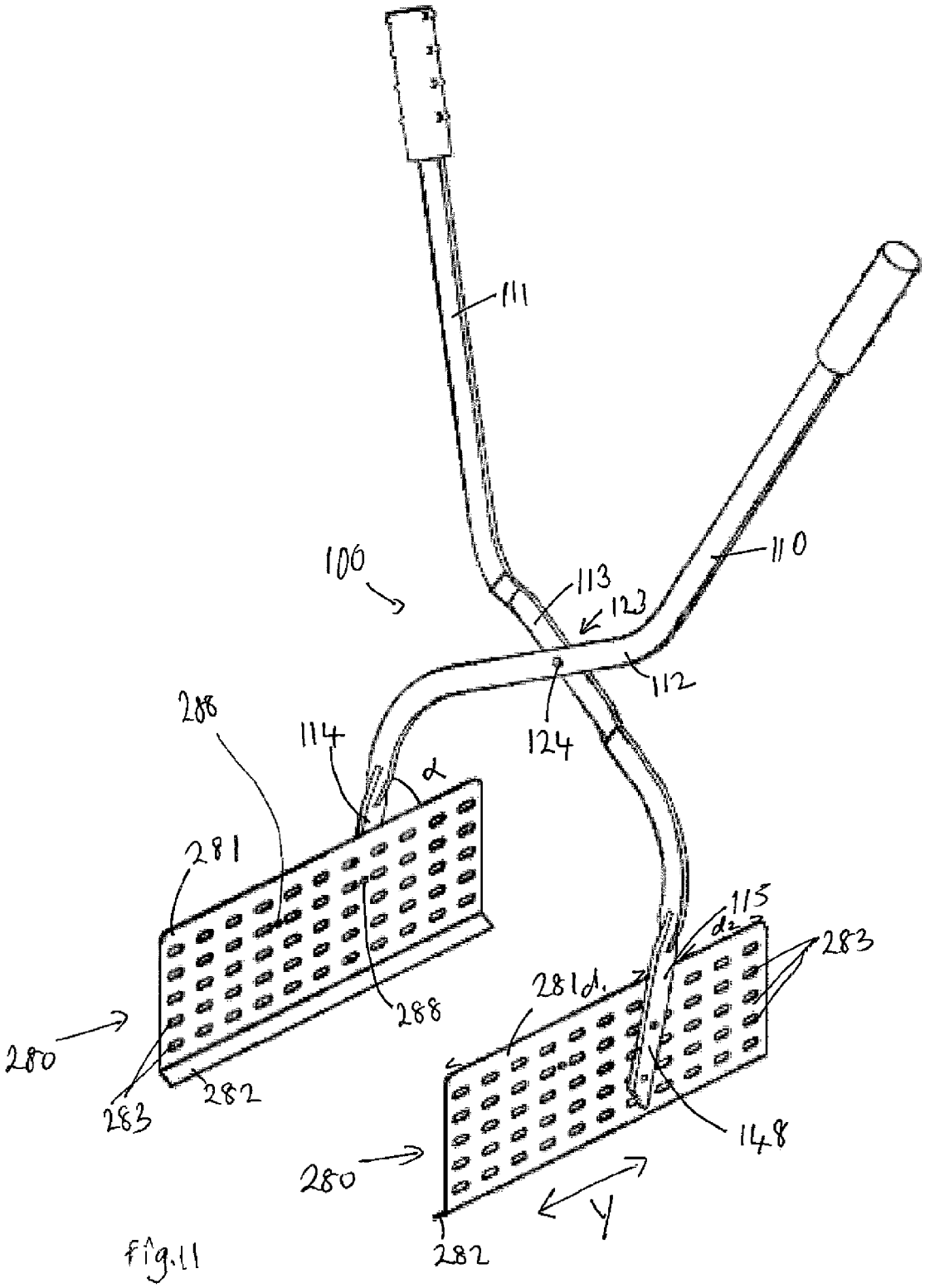
FIGS. 11 and 12 are front perspective, front plan views of a device of an alternative arrangement.

Referring to FIGS. 9 and 10 the blade 280 of the FIGS. 9 to 14 arrangement is described in further detail. The blade 280 is similar to blades 140, 141 and 180. (As the legs 110 and 111 of the embodiment of FIGS. 9 to 14 are similar to those of the embodiment of FIGS. 1 to 4 and the manner of connection is similar, the reference numbers relating to the blade 280 have been noted in the descriptions of exemplary embodiments of the device above).

As shown the blade 280 may comprise an upper portion 281 and a lower portion 282. The lower portion 282 is defined by a beveled lip which is continuous with the upper portion 281 and arranged at an angle β thereto. The blade comprises first and second connection holes 288. The blade 280 is reversible for connection to either the first or second leg 110, 111. Each leg 110, 111 is connectable to the blade via one of the connection holes 288 and one of the through holes 283 provided thereon. The blade comprises a lower blade edge 284.

As described previously the legs may be connected to the blades such that the handles are oriented rearwardly of the blades in the direction of the user. This is achieved by making a first connection via one of the connection holes 288 and a through hole 283 located forwardly of the selected connection hole.

The provision of a reversible blade 280 is advantageous from the point of view of providing a device suitable for flat packing and for simplification of the tooling and manufacturing processes.

While in the exemplary embodiment of the drawings and the above, the blades are of substantially rectangular form having minor axis arranged at an angle to the vertical to define a capture volume closed to the end proximal to the ground or supporting surface when the blades are in the closed position, it will be appreciated that blades of suitable alternative form may also be used for example blades having a curved or c-shaped form in lateral cross-section/in the direction of the minor axis. It will therefore be understood that it is not intended to limit the teaching of the present specification to any one specific arrangement of blade geometry or material. It would be appreciated that various alternative forms of blade may be used for example a blade having a straight lower edge but curved upper edge might be used. It will be appreciated that the possible range of depths of the blade from the lower edge to the upper edge is provided by the form of the legs or handles in particular the location of the lower bend feature.

It will be appreciated that the blades may further include a strengthening features for example a strengthening rib or curved upper portion or curved upper edge.

The legs 110 and 111 are configured to support the blades at the required orientation and facilitate the opening and closing thereof. The legs 110 and 111 are articulated and interconnected at a pivot or scissor joint 123. In this case of the exemplary embodiment, the joint is located below the mid-point of each leg from the upper handle end to the lower blade end. The location of the fulcrum at a lower region of the tool provides for a lowering of the centre of gravity of a loaded tool to enable the user to carry or manipulate heavier loads. The legs 110 and 111 are connected to each other by means of a fixing pin 124 through corresponding connection holes, although it will be appreciated that any fixing means could be utilized.

The first leg 110 comprises a setback or recessed portion 112 near the joint 123 to accommodate movement of the legs 110 and 111 relative to each other about the joint. The form of the setback portion 112 defines a stop which limits the extent of movement of the legs relative to each other.

It will be appreciated that while in the arrangement described the leg 110 includes a setback feature to accommodate location and movement of the second leg to the rear thereof the setback may be provided in either leg.

The legs 110, 111 may be considered as having two main portions namely the upper portions 110A and 111A and lower portions 110B and 111B. The lower portions are formed and arranged for connection to the blades 140, 141 (and 280). The upper portions could be arranged to provide extended length through for example a telescopic arrangement so as to allow persons of different height to use the tool. Using an arrangement where for example two lengths are slideable relative to one another and can be secured in any one of a number of different positions—such as for example as is used within crutch manufacture—the person using the tool can choose the most appropriate length of the tool for their height.

The legs 110 and 111 of the exemplary embodiment of FIGS. 1 to 6 have a substantially rectangular cross-section. In the upper portions 110A and 111A the broad sides of the rectangular cross section are oriented to the front and rear of the device, and in the lower portions 110B and 111B the broad sides of the rectangular cross section are oriented substantially at right angles thereto and being so arranged to receive and abut the surface of the blades near the connection points 148 thereof. Presentation of the broad side of the rectangular cross-section to the surface of the blades provides a sturdy and robust support. The broad side provides an increased area of direct overlap.

The legs comprise a number of bend features. Bend features 116A and 117A are located to the upper handle side of the joint portion 123 and at these points the legs are oriented in the direction of the joint 123 to provide for cross over at the joint. The legs further comprise bend features 116B and 117B located to the lower blade side of the joint. At the bends 116B and 117B the legs are angled to point downwardly and to define connection portions 114, 115 for connection of the blades 140 and 141 at the required orientation for operation of the device.

The legs 110 and 111 may further comprise twist features 120, 121 located below the joint 123 at which point the rectangular cross-sectional form of the leg is rotated or oriented through substantially 90 degrees to define the blade connection potions 114, 115. At the blade connection portions 114 and 115 the legs are oriented to present a broad side of the rectangular cross section for connection to the blades 140, 141, as mentioned above.

Figure 15C:
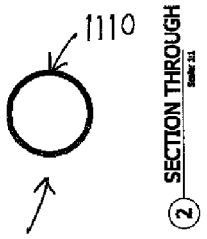
FIG. 15C is a cross-sectional view in the line A-A of FIG. 15B showing the circular cross-sectional form of the tubular legs of this arrangement.
Figure 15B:
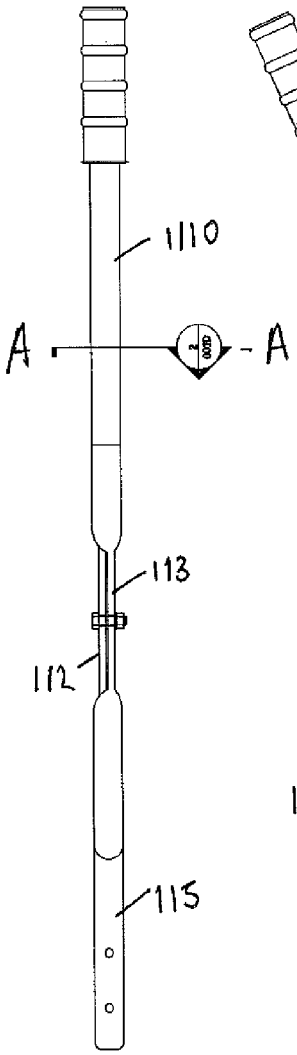
FIG. 15B is a plan view from the side of the device of FIG. 15A.
Figure 15A:
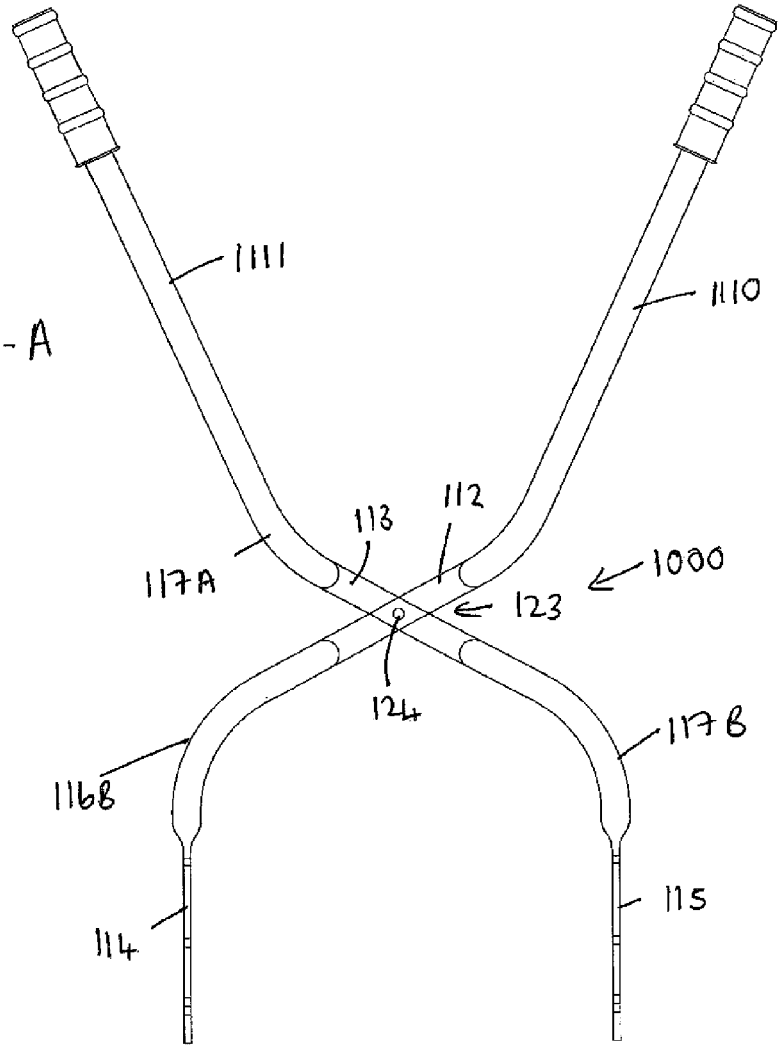
FIG. 15A is a plan view from the front of a device of an alternative arrangement in which the legs are generally of tubular form.

The legs 1110 and 1111 of the exemplary embodiment of FIGS. 15A, 15B and 15C have a substantially tubular form having a substantially circular cross-section and are preferably hollow. In this case the upper portions 1110A and 1111A and the lower portions 1110B and 1111B comprise portions having the tubular form. The legs 1110 and 1111 are similar in form to the legs 110 and 111 and the same reference numerals have been provided to indicate similar features. The main difference between the legs 1110 and 1111 and 110 and 111 is in the form thereof which comprises a number of tubular portions. The legs 1110 and 1111 comprise similar features to the legs 110 and 111, for example, the set-back portion 112 at the joint 123 and corresponding flattened portion 113 for locating the leg 1111 at the joint 123, connection holes 124. The legs 1110 and 1111 also comprise a similar curved form defined by the bends 116A, 116B, 117A and 117B and the lower connection portions 114 and 115.

The generally tubular form or circular cross-section of legs 1110 and 1111 may be formed or flattened to provide the noted features including the setback portion 113 is provided so the legs may overlap at the pivot joint 123 or to form connection portions 114 and 115 where the legs are connected to the blades 140 and 141, (or 180/280). The provision of legs, a relatively large proportion of which, are of tubular form advantageously provides a relatively lightweight device.

While two exemplary forms of the legs are noted above. It will be appreciated that the key to the arrangement of the legs of the device is not limited to the material arrangement or form of the cross-section of the legs. Advantages of the arrangement of the legs of the device lie in the form of the legs and the features of the legs, including the lower bend features 1168 and 1178 which are located outwardly in the lateral direction, illustrated in FIG. 12 as the Z-direction relative to the pivot point 123 and connection portions 114 and 115 for connection to the blades. These curved portions are provided to accommodate and support the blades at their required orientation when closed.

The arrangement of the legs ensures that the blades may be connected to the legs at the required orientation and further provides a suitable planar connection area 114 and 115 for connection of the blade to the legs ensuring good stability and a strong supporting connection. It will further be noted that the blades 140, 141, 180 and 280 overlap a relatively extended part of the legs at the connection portions 114, 115 which arrangement again provides for excellent stability and strength of the connection. The overlap between the blades and the blade connection portions 114, 115 of the legs provides for greater stability and support than would be the case if an upper part of the blades was connected to the end of the legs.

The overall length L1 of the legs 110, 111 is selected to provide a device 100 suitable for use by a user in the standing position. The legs 110, 111 are oriented at an angle $\alpha$ relative to the major axis of the blades and supporting surface in the direction of the user. This arrangement provides a device which is ergonomic and easy to use.

Figure 12:
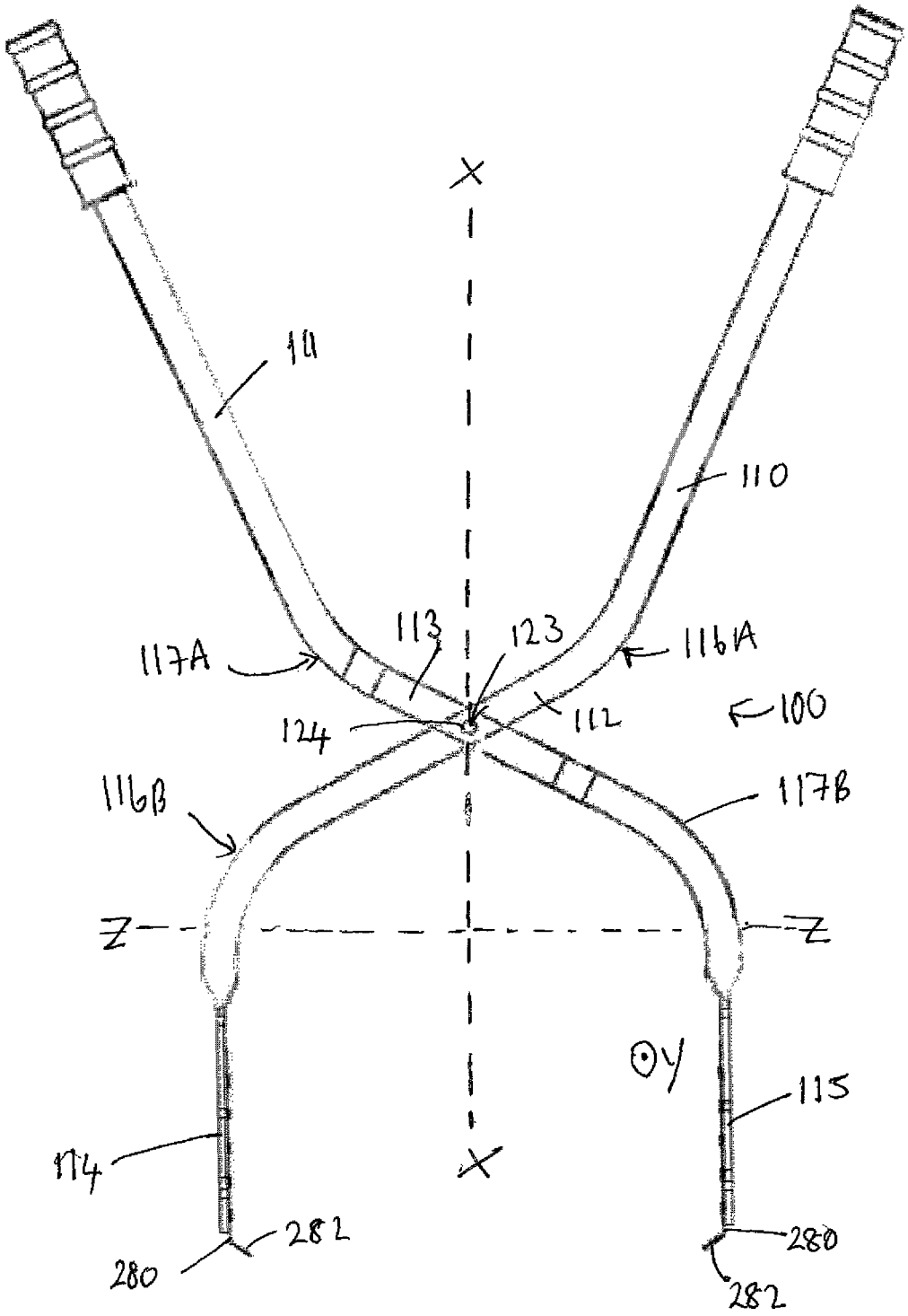
Figure 13:
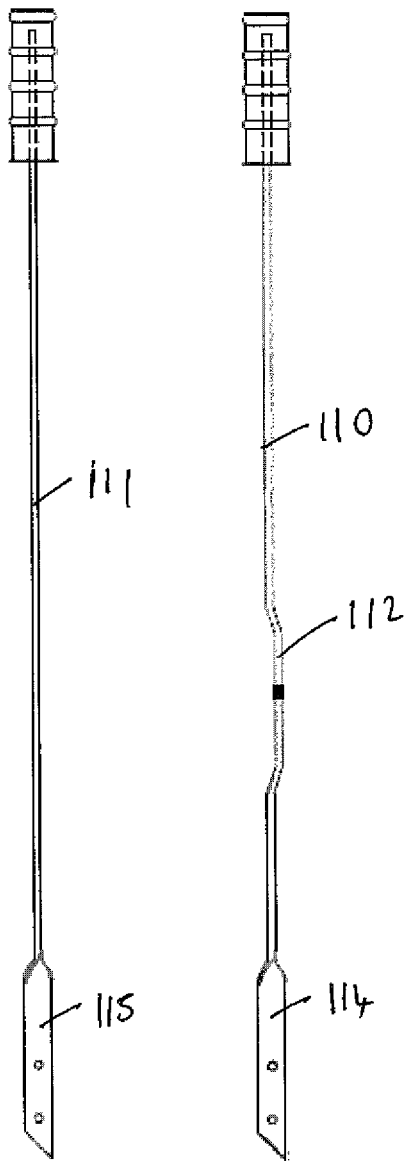
FIGS. 13 and 14 are side plan and front plan views of the legs of the device of FIGS. 11 and 12.
Figure 14:
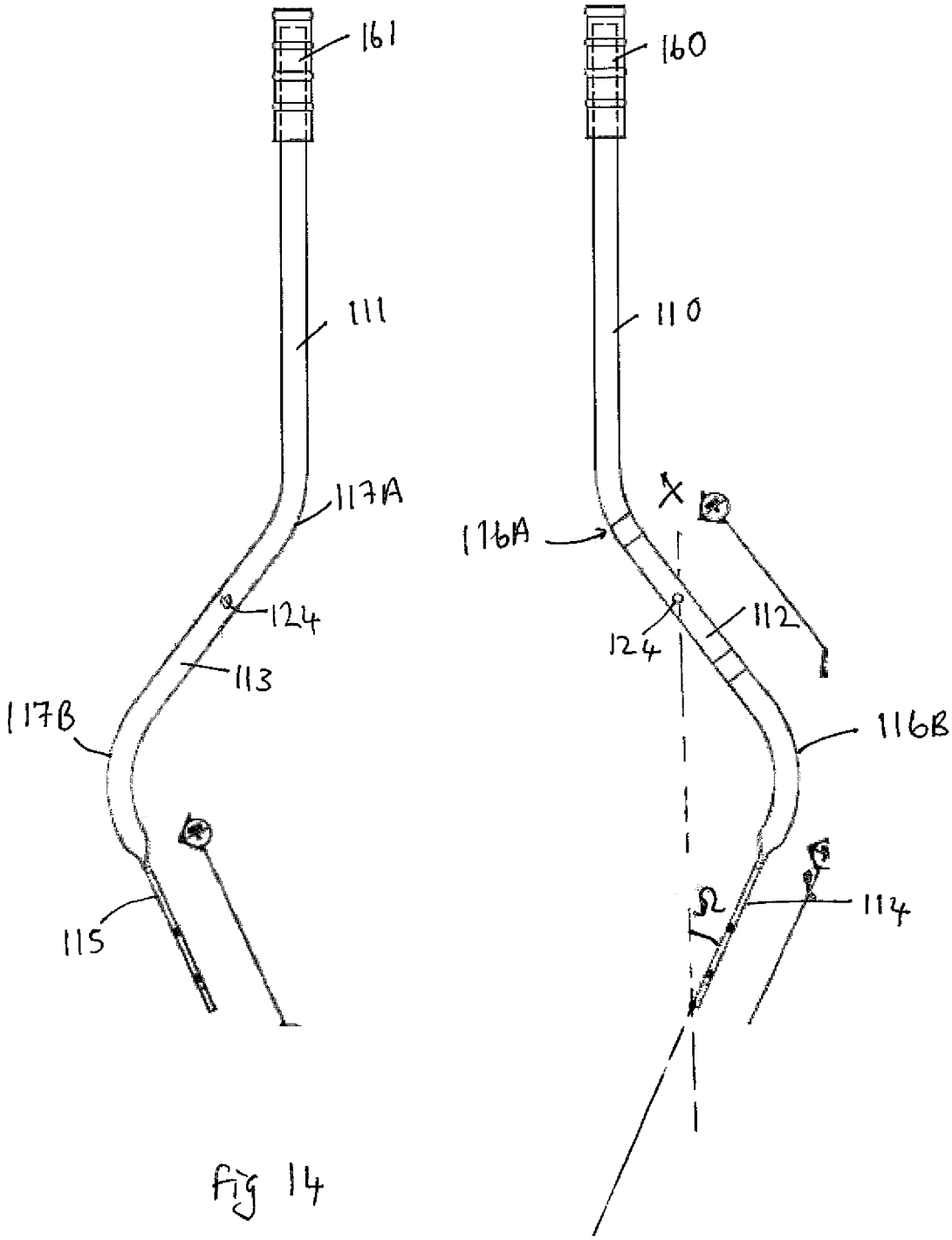

Referring to FIGS. 11, 12, 13 and 14 the arrangement of the legs and the blades of the device is described in further detail. When the blades are connected to the legs the major axes of the legs is defined by the longitudinal axes of the legs from the lower ends to the upper ends thereof. When connected, the legs are arranged about a central longitudinal axis X of the device. The legs are curved in form as shown in the front plan views and extend laterally in the Z and −Z directions about this central X-axis as shown (FIG. 12). The legs lie in a plane oriented at an angle to the vertical and to the blades as described above.

As noted above the legs comprise bends and connection portions 114 and 115 of the legs are oriented to provide support for the blades at the required angle such that when the device is closed the blades slope outwardly from the lower edges thereof. Referring to FIG. 12 it is indicated that the connection portions 114 and 115 of the legs are arranged at an angle $\Omega$ relative to the straight upper portions of the legs which extend from the handles to the first bend features 116A and 117A. This angle may be in the range of 20 to 40 degrees, preferably between 25 and 35 degrees The blades each comprise a major axis defined by the longitudinal axes of the blades from the front edge to the rear edge thereof, indicated in FIG. 11 as the X-axis. As noted above the connection of the legs to the blades is such that when the lower edges of the blades are at rest on the ground the legs are oriented rearwardly relative to the lower edge of the blades in the direction of the user at an angle $\alpha$ to the Y-axis or upper or lower blade edges. The legs lie in a plane arranged at an acute angle to the upper and lower edges of the blades (and the longitudinal axis of the blades) when the lower edges are resting on the ground or supporting surface.

It is noted that the blades 140 and 141, 180 and 280 have an elongate form.

The blades are elongated relative to the depth thereof in the embodiments shown and also relative to the width of a typical shovel or dustpan.

In this case blades are substantially in the ratio of 1:2.5 times the length of the handles.

In an exemplary arrangement, see FIGS. 9 to 14 for example, the blades each have a length of the order of 330 mm from the front side edge thereof to the rear side edge thereof. Each blade has a depth of the order of 124 mm from the top edge to the lower edge—here defined by an upper blade portion 281 of depth 115 mm and a lower blade portion or lip portion 282 of 14 mm. The lower portion is arranged at an angle $\beta$ of substantially 34 degrees to the upper portion.

The legs of the example have a length l1 of the order of 815 to 830 mm, desireably of the order of 823 mm from handle to tip. Thus the ratio of the length of the legs from the upper ends to the lower ends relative to the length of the blades from the front edges to the rear edges thereof is substantially of the order of 2.5: 1.

As noted above when the device is closed the blades are arranged to slope outwardly relative to each other with the upper portions of the blades at an angle of $\theta$ to each other and an angle $\theta/2$ to the vertical. In the exemplary arrangement the angle $\theta/2$ is of the order of 20 to 40 degrees, most preferably between 25 and 35 degrees. As noted above the lower portions or the lip portions 282 of the blades are arranged at a greater relative angle to each other.

Desirably the tool is arranged such that it is free standing—the length of the blades being sufficient that their contact with the ground provides support for the tool in a vertical orientation. In this way the user does not have to bend down to pick up the tool each time they wish to use it.

Modes of Operation

The device is operable in a number of modes including:

- a first open/collection mode, when the blades are separated and moveable between a range of open positions to effect collection of debris. The blades may be moved towards and away from each other to effect a movement to assist in the collection of debris centrally between the blades. The device may be moved in the forward and rearward direction in a sweeping type action. The use of planar surfaces is particularly advantageous for quick release of collected debris;
- a second closed mode where the blades are closed together to grip or hold a collected load or volume of debris; and
- a third standing mode where the blades are separated and placed with the lower side edges in contact with a supporting surface to stand the device in a generally upright rest position. It is easy for the user to access the device from the upright resting position.

Device may be manufactured of a metal or plastics material or a combination thereof. The legs and blades may be manufactured by a process of molding. In a preferred embodiment, the legs may be of a metal material and the blades of a lighter plastics material. In a further preferred embodiment the entire device, legs and blades may be manufactured of metal material to provide a durable and long-lasting device having high levels of strength. Manufacture of the device takes account of requirements for flat packing of components ease of storage and transport and for ultimate assembly by the end user. The legs may be provided as separate components for interconnection and the blades may be provided as separate components for assembly. Assembly may be effectively a one or two step process. Provision of the tool as a flat pack product further minimizes packaging, storage and transport costs. The number of component parts is minimized to ease manufacture and final assembly. The blades are connectable to the legs using a suitable connection means such as a rivet or bolt arrangement. Similarly, the legs are connected to each other about the pivot joint using an appropriate connection means. It will be understand that various suitable alternative connection means may be used as required. It will be appreciated that the components may be painted or coated or otherwise treated to afford weatherproofing and weather protection.

Advantages

The legs of the device effectively comprise the manual drive portion of the present device. The features of the blades in particular the special configuration of the blades and the manner of their connection to the legs with the major axis substantially at right angles to the legs are key to defining a device having a relatively large capture volume and which at the same time is well balanced and easy for a user to operate.

The provision of a device in which the blades are configured such that a major proportion of the length of the blades project forwardly of the connection to the legs similarly provides for an increased capture volume, load balance and ease of load handling.

The provision of blades arranged in accordance with an aspect of the description to slope outwardly from the lower end to the upper end has the further advantage of providing an increased capture volume than could be achieved if the capture surfaces abutted when closed.

At the same time the provision of blades the lower ends of which are proximal in the closed position and the upper ends of which are separated from each other provides a device which is suitable for use in "fine" handling at the lower blade ends and which provides the user viewing the load from the top of the device with a clear and unobstructed view of the lower blade ends or of the captured debris. This increases the ease of use and user friendliness of the device.

The provision of a device in accordance with the present description, in which the legs are oriented at an angle $\alpha$ to the major axis of the blades or to the supporting surface towards the user, advantageously increases the ease of use of the device. The arrangement is ergonomic from the point of view of the user.

The provision of a device in accordance with the above specification with the facility for changing or replacing the blades depending on the required use has the advantage of providing a device which is adaptable. Such a device can be used in either a domestic or commercial environment where movement of material without physical handling of the material is required. For example in a domestic environment there is a desire when moving garden waste having thorns etc., that the waste can be moved without requiring the user to physically touch the material. This can be achieved with a device such as that provided in accordance with the present teaching. In a commercial environment where for example sharps or other industrial type waste requires movement, there is an advantage in being able to transport it between the blades without physically touching it. The tool can be used to scrape, scoop and gather all in one motion. The provision of multi functions within the same tool provides an advantage to the user and coupled with its compact nature means that it can be easily stored and used. As it is relatively light weight and has a low positioning of its fulcrum, it is possible for a user to readily transport or move heavy articles without undue effort.

The arrangements described in the specification provide a number of advantages both in the configuration and for use, for example, as noted below:

1. Blade form and resultant capture volume form:

As noted above, the first and second blades each comprise upper and lower blade portions. The lower blade portion is defined by the lips which are continuous with the upper portion. When closed the upper potions of the blades are arranged at a first angle relative to each other and lower lip portions at a second and greater relative angle. The lip portions of opposing blades cooperate when closed to essentially offset the upper portions by a distance defined by the depth and angle of the lower lip portions.

In effect, the upper and lower portions of each respective blade cooperate together when closed to define the overall capture volume. The device does not merely have a pointed v-shaped capture volume but rather a substantially v-shaped volume having a relatively wide angle lower base or shelf portion. The upper blade portions are furthermore offset relative to each other by the cooperating lower lip portions.

The capture volume as defined by the blades when in the closed position, is closed at the end proximal to the ground as defined by the lower edges and lip portions of the blades. The capture volume is open to the upper side The lips of the blades when closed co-operate define a relatively wide angle base of the capture volume which is effectively a shelf feature that provides for a secure containment of captured debris. Furthermore, as the blades are open to the upper side this enables the capture of debris without the form of the blades placing any limitation on the amount of debris which can be captured or contained there-between.

2. Distribution and balance of the relatively large capture volume and improved load distribution Each blade is connected to each leg such that a greater proportion of the surface area of each blade is arranged to the front of the leg than to the rear.

This provides for a greater proportion of the capture volume and of loads captured in the device to be distributed to the front of the blade to leg connections which in turn provides for an improved load distribution and balance.

3. Lip feature—defines lower portion of the capture surface and the ground/debris contacting surface As noted above the blades comprise upper and lower surface portions defining a lip features. The arrangement of the blades and the lip features has been found to extend the range of functionality of the device.

The first and second blades each comprise upper and lower blade portions. The lower blade portion is defined by the lips which are continuous with the upper portion. The upper potions of the blades are arranged at a first angle relative to each other and lower lip portions at a second and greater relative angle.

When the blades are in the closed position the lip portions meet and cooperate. The lower lip portions which meet when closed are arranged at a relatively wide angle to each other effectively defining a shelf for a secure containment of debris therein.

When the blades are in an open position the lip portions are by virtue of their configuration presented to the ground or supporting surface at a relatively wide angle.

Extended Functionality of the Device

The provision of the blades having relatively wide angled lip portions that extend continuously with the blades and that meet when closed, opens up new possibilities for the use of the device, including the following:

to securely contain waste when closed to transport waste contained therein when closed to effect a sweeping or scraping of waste on/over a surface when open The relatively wide angle of presentation/contact of the lip portions to the ground when open provides for the use of the device for applications such as scraping or sweeping waste on the ground. The lip may be easily and effectively moved along the ground thus moving waste. As the device provides for secure containment of relatively large volumes of debris, the application of the device is extended beyond grabbing and dropping waste to a device which may be used for collecting, holding and then if required transporting the waste contained therein.

The device further exhibits a special load balance and distribution which is of particular significance when the device is being used for transporting waste contained therein.

The device as embodied by the combination of the features of the claims has been found to provide a number of key advantages over prior art devices that make the device effective for the tasks to which it is applied and easy to handle and manipulate making it furthermore usable and user friendly.

Advantages of the Above Noted Features Include the Following:

Large capture volume/outward sloping blades provided in a compact device

The device comprises a relatively large capture volume. The capture volume is achieved by the special arrangement of the blades and features of the blades, including: the angled outward sloping arrangement of the blades from the lower edges when closed and the provision of the lip portions which offset the main capture surface areas.

Furthermore, the capture volume in the exemplary arrangements of FIGS. 1 to 14 is closed only to the lower end which is proximal to the ground and not to the upper side. This means that the capture volume is not limited to the upper side and that the device may be used to hold material between the capture surfaces but material may also be located above the tops of the capture surfaces. The blade form does not limit the amount of material at an upper side in the way it does at the lower side.

Additionally the provision of blades that slope outwardly from the lower contacting edges when closed ensures that a user located generally behind and above the blades will have an unobstructed view of the waste and the position of the blades relative to waste to assist in a precise handling of the device.

The provision of the blades having upper and lower capture surface portions, the lower surface portions defining a lip is further advantageous. In effect the blades comprise a first v-shaped capture surface as defined by the lower lip portions within a second v-shaped capture surface as defined by the upper portions. The lower portions meet when the blades are closed defining a relatively wide angled shelf or base portion for the containment of waste. The lower edges furthermore contact a supporting surface at a relatively wide angle when open providing for improved ease of waste handling. The device is suitable for handing fine waste for example, dust, broken glass or sharps as well as for handling more conventional binding waste, for example, leaves or grass cuttings.

Load Distribution and Balance

The arrangement of a greater proportion of the capture surface of each blade forward of the legs than to the rear of the legs provides for a load balancing of the device and of debris captured therein. When the device is loaded a user may simply tilt the device to raise the front of the blades upwardly to begin the lifting motion. The fulcrum of the blades is located relatively near to the rear of the device which assists the user in this motion of handling the device and any load therein. The device as defined in the claims is advantageously an ergonomic device.

Extended functionality—sweeping/scraping mode and holding/transport of waste mode. The provision of the device in which the lower longitudinal edges as defined by the lip portions are arranged to contact the ground or a supporting surface at a relatively wide angle extends the functionality of the device. The angle of the lip and lower longitudinal edge means that this device may be used not just for lifting material, for example, from the top of a pile of waste but also to scrape, sweep, or move material along the ground or supporting surface. The two lips meet at a relatively wide angle when being closed together further assisting with the collection of waste into the device.

The provision of blades are the similar in form is advantageous as either one of the blades may be moved across a surface to move material on the surface or for scraping or sweeping waste on the ground. This means that the device may be used ambidextrously by a left-handed or right-handed user.

The lips extend continuously with the blade from front to back and are arranged to meet from front to back. Thus any portion of the lower edges may be used to contact the ground or collect an item of waste or to operatively sweep or scrape. The blades do not comprise fork tines or other features. The surfaces are substantially planar in form. There are no features that will retain waste or otherwise become clogged with waste when the blades are opened to drop a load. By the special combination of features the device advantageously demonstrates a wide range of functionality.

The words comprises/comprising when used in this specification are to specify the presence of stated features, integers, steps or components but does not preclude the presence or addition of one or more other features, integers, steps, components or groups thereof.

The invention claimed is:

1. A tool for collecting debris comprising:

first and second legs pivotably coupled to one another and each having a handle portion, first and second collection blades angularly coupled to respective ends of the first and second legs distal to the handle portion and coupled at substantially a same connection point on each blade where a first distance to a first end of each blade is greater than a second distance to a second end of each blade, each of the legs being angled at a coupling angle in a range of approximately 71 degrees to 89 degrees with respect to each lower longitudinal edge of each blade, each blade further including a first portion extending in a direction away from the handle portion and a second portion extending in a direction toward the handle portion, a surface area of the first portion of each blade being greater than a surface area of the second portion of each blade, whereby the configuration of the coupling angle and the same connection point of the legs on each blade in relation to dimensions of the first portion and second portion of each blade provides for a load balancing of the tool and of debris captured therein, the blades being further arranged relative to one another to define opposing captured surfaces, the blades each including lower longitudinal edges arranged to meet in a closed position with the opposing capture surfaces sloping outwardly relative to each other from the lower longitudinal edges to define a capture volume, and the opposing capture surface of each blade including an upper portion and a lower portion, the lower portion defining a bevelled lip continuous with the upper portion, the upper portions of the blades being arranged at a first angle relative to each other and the lower lip portions being arranged at a second and greater relative angle to each other.

2. The tool of claim 1 wherein the blades are arranged such that when closed a depth and relative angle of the lower portions thereof operably defines a separation of the corresponding upper portions thereof.

3. The tool of claim 1 wherein each blade has a major longitudinal axis which extends from a forward end to rear end thereof wherein the major axis is oriented substantially at right angles to the legs.

4. The tool of claim 1 wherein the lower longitudinal edges of the blades are substantially straight and are configured to contact a supporting surface.

5. The tool of claim 1 wherein the blades are removably connectable to the legs.

6. The tool of claim 5 including a plurality of sets of blades differing from one another in their form or material, each set of blades being provided for different specific applications and being user replaceable such that depending on the application a user may interchange one set of blades for another set of blades.

7. The tool of claim 1 wherein the upper and lower portions of the blades comprise a substantially planar form.

8. The tool of claim 1 wherein the blades comprise a substantially rectangular form.

9. The tool of claim 1 wherein the blades have one or more through holes formed in the surface thereof.

10. The tool of claim 1 wherein the lower portions or lip portions partially or wholly overlap when the blades are in a closed position.

11. The tool of claim 1 wherein the blades are oriented to support the tool in a self-standing position with the lower longitudinal edges of the blades in contact with a support surface when the blades are in an open position.

12. The tool of claim 1 wherein a length of the blades is sufficient to allow the tool to be free standing with the handle portion extending upwardly from the blades.

13. The tool of claim 1 wherein substantially two thirds of the surface area of each blade is arranged to a front of the leg.

14. The tool of claim 1 wherein substantially two thirds of a length of the lower longitudinal edge of each blade is arranged along an axis in a direction away from the handle portion.

15. The tool of claim 1 wherein the lower longitudinal edges are configured to substantially meet along their longitudinal extent from a front end to a rear end of the blade when closed.

16. The tool of claim 1 wherein the surface area of the lower lip portion of each blade is less than that of the upper portion of each blade.

17. The tool of claim 1 wherein the upper and lower portions of the capture surface of each blade comprise a generally rectangular form.

18. The tool of claim 1 wherein the capture volume comprises a generally v-shaped form.

19. The tool of claim 1 wherein the capture volume comprises a broad base portion as defined by a relatively wide angle orientation of corresponding edges of the lower portions or lip portions which meet when closed.

20. The tool of claim 1 wherein the blades further comprise upper longitudinal edges, wherein the upper longitudinal edges are maintained at a separation when the blades are closed.

21. The tool of claim 1 wherein the legs are coupled to the blades such that the legs are oriented at an angle of 75 to 83 degrees to the lower edges of the blades in a direction of a user standing to a rear side of the tool.

22. The tool of claim 1 wherein the legs comprise an upper portion and a lower portion formed and arranged for connection to the blades.

23. The tool of claim 22 wherein the legs are formed such that the lower portions formed and arranged for connection to the blades are arranged to accommodate outwardly sloping blades.

24. The tool of claim 22 wherein the lower portions that are formed and arranged for connection to the blades are configured to support the blades in an outward sloping configuration when closed, the lower portions extending outwardly relative to a pivot joint to a lower bend at which point the lower portion is angled relatively downwardly and inwardly to define a connection portion for connection to an outer surface of the blade.

25. The tool of claim 24 wherein connection portions of the legs comprise a rectangular cross-section oriented such that a broad side of the rectangular cross-section is presented to an outer surface of the blade for connection to the blade.

26. The tool of claim 25 wherein the broad side of the rectangular cross section is oriented through a twist feature to provide a supporting overlap between each blade and leg.

27. The tool of claim 1 wherein a pivot joint is located below a midpoint of each leg from the upper handle end to the blade to pivotably couple the first and second legs.

28. The tool of claim 1 wherein the first leg comprises a recessed portion about a pivot joint configured to accommodate movement of the second leg relative to the first about the pivot joint.

29. The tool of claim 28 wherein the recessed portion defines a stop which limits the extent of movement of the legs relative to each other.

30. The tool of claim 1 wherein the legs are formed as single unitary pieces.

31. The tool of claim 1 wherein the legs comprise upper and lower bend features.

32. The tool of claim 1 wherein the legs are formed as solid bars of generally rectangular cross-section.

33. The tool of claim 32 wherein an upper portion of the leg is arranged such that a broad side of the rectangular cross-section of the leg is oriented to a front and rear of the tool.

34. The tool of claim 1 wherein the legs comprise a tubular form substantially of circular cross-section.

* * * * *